US007419297B2

(12) United States Patent
Noirjean

(10) Patent No.: US 7,419,297 B2
(45) Date of Patent: Sep. 2, 2008

(54) CONTROL DEVICE FOR A PUSH-PIECE, IN PARTICULAR FOR TIME PIECE, AND PORTABLE ELECTRONIC INSTRUMENT COMPRISING SAME

(75) Inventor: Pierre-André Noirjean, Develier (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 221 days.

(21) Appl. No.: 10/532,497

(22) PCT Filed: Oct. 14, 2003

(86) PCT No.: PCT/EP03/11362

§ 371 (c)(1),
(2), (4) Date: Apr. 25, 2005

(87) PCT Pub. No.: WO2004/038517

PCT Pub. Date: May 6, 2004

(65) Prior Publication Data

US 2005/0270909 A1 Dec. 8, 2005

(30) Foreign Application Priority Data

Oct. 28, 2002 (EP) ..... 02079510

(51) Int. Cl.
*G04C 9/00* (2006.01)
*H01H 50/56* (2006.01)

(52) U.S. Cl. ..... 368/187; 368/69; 200/283

(58) Field of Classification Search ..... 368/69, 368/187; 200/283
See application file for complete search history.

(56) References Cited

U.S. PATENT DOCUMENTS 3,860,776 A 1/1975 Lockard (Continued)

FOREIGN PATENT DOCUMENTS

CH 3 719/76 A4 8/1977

(Continued)

OTHER PUBLICATIONS

Patent Abstracts of Japan, vol. 002, No. 040, Mar. 16, 1978 & JP 53 003866 (Citizen Watch Co., Ltd.), Jan. 13, 1978.

*Primary Examiner*—Vit W. Miska
*Assistant Examiner*—Sean Kayes
(74) *Attorney, Agent, or Firm*—Sughrue Mion, PLLC

(57) ABSTRACT

There is disclosed a control device including (i) a support (4, 4.1), (ii) an electronic module (6, 60) arranged in or on the support, (iii) a push-button (2.1 to 2.5) mounted to be mobile on the support so as to have a travel in translation along an axis of actuation, (iv) a first contact element (210) including a mobile part (211) placed on the axis of actuation so as to be actuated by the push-button, and (v) a second contact element (220) with which the mobile part of the first contact element can be brought into contact in order to establish an electric connection between the two contact elements, the electronic module including at least one contact pad (610, 620) in electric contact with the first or second contact element, the other contact element having a determined electric potential. The first and second contact elements are respectively formed of a first metal contact strip (210) and a second metal contact strip (220) both carried directly by said support (4, 4.1). The first and second contact strips, as well as the push-button, are thus mounted on the same frame, namely the support, such that the arrangement and the travel of the push-button can be controlled and fixed with a high level of precision.

There is also disclosed a portable electronic instrument, such as a timepiece, including such a push-button control device.

12 Claims, 10 Drawing Sheets

U.S. PATENT DOCUMENTS

| | | | | | |
|---|---|---|---|---|---|
| 3,952,176 | A | * | 4/1976 | Holder et al. | 200/11 R |
| 4,062,181 | A | * | 12/1977 | Zurcher | 708/111 |
| 4,130,986 | A | * | 12/1978 | Ramet | 368/224 |
| 4,209,976 | A | * | 7/1980 | Flumm | 368/187 |
| 4,430,532 | A | * | 2/1984 | Matsumoto | 200/52 R |
| 4,536,095 | A | * | 8/1985 | Wuthrich et al. | 368/321 |
| 5,774,427 | A | * | 6/1998 | Rebeaud | 368/321 |
| 6,344,706 | B1 | | 2/2002 | Morita et al. | |
| 6,846,998 | B2 | * | 1/2005 | Hasumi et al. | 200/341 |
| 2001/0022759 | A1 | * | 9/2001 | Paratte | 368/69 |

FOREIGN PATENT DOCUMENTS

| | | | |
|---|---|---|---|
| EP | 1 089 144 | A1 | 4/2001 |
| EP | 1 162 251 | A2 | 12/2001 |
| FR | 2 344 882 | | 10/1977 |
| WO | WO 96 25694 | | 8/1996 |

* cited by examiner

COUPE A-A

COUPE B-B

Fig. 6a
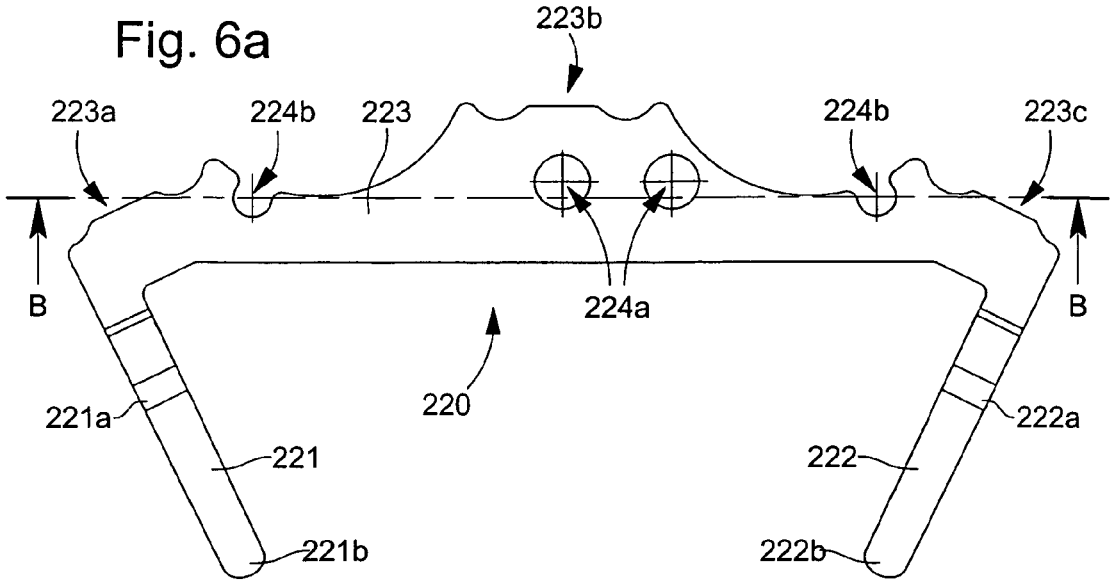
Fig. 6b
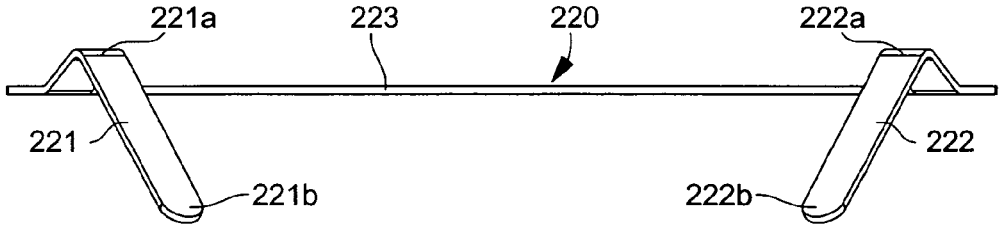
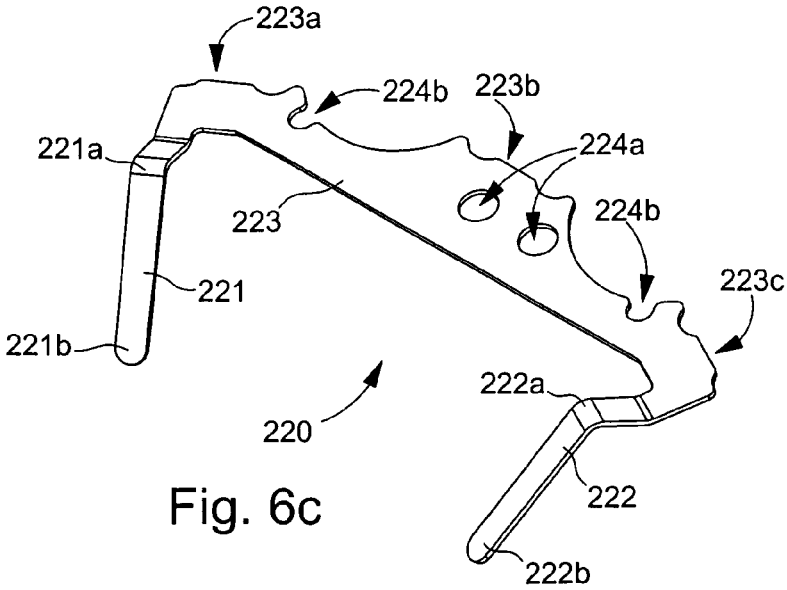
Fig. 6c

Fig.7b
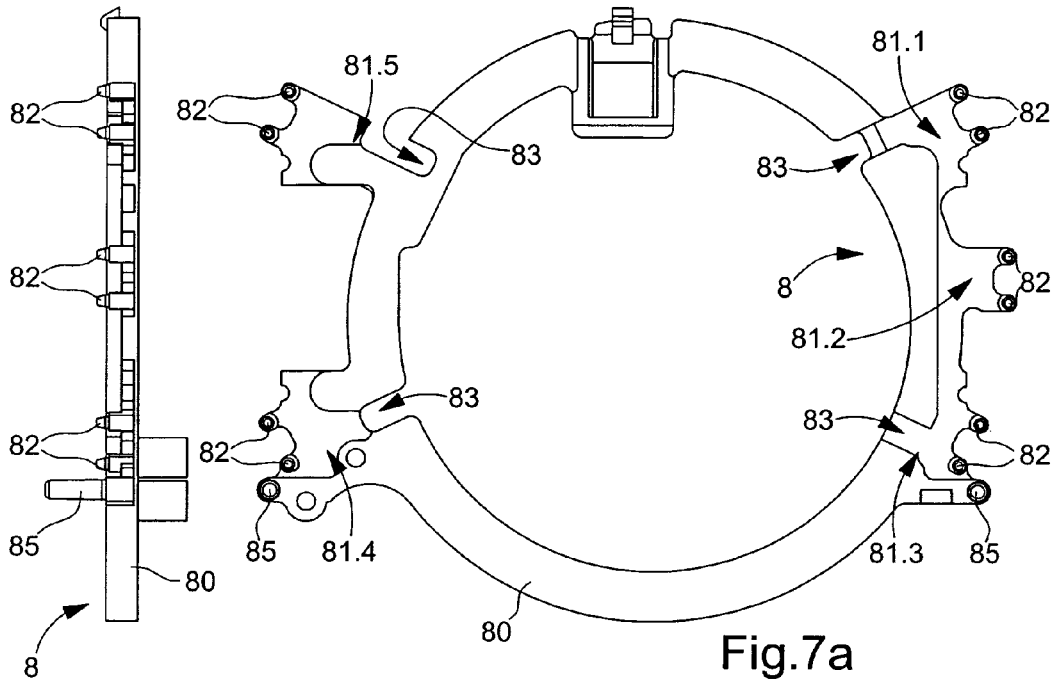
Fig.7a
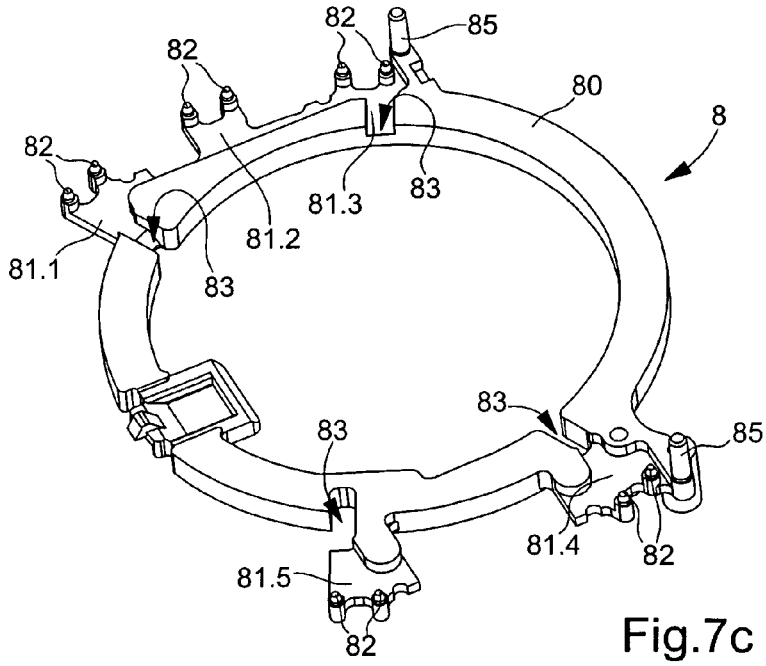
Fig.7c

CONTROL DEVICE FOR A PUSH-PIECE, IN PARTICULAR FOR TIME PIECE, AND PORTABLE ELECTRONIC INSTRUMENT COMPRISING SAME

BACKGROUND OF THE INVENTION

The present invention concerns generally a push-button control device of the type encountered particularly in electronic or electromechanical timepieces. The present invention also concerns a portable electronic instrument, such as a timepiece, including such a push-button control device.

Such push-button control devices are very widespread, particularly in the field of electronic or electromechanical timepieces. A typical example of such a control device is given in EP Patent No. 1 089 144. This document discloses in particular a multi-function push-button contact strip essentially formed of a base fixed to the bottom of a case in proximity to the push-button and an elastic blade forming a mobile contact element capable of being actuated by the push-button. This contact strip forms a first contact element of the control device, the elastic blade of the strip cooperating with a second contact element arranged on an electronic module for establishing an electric connection when the push-button is actuated.

From the electrical and mechanical point of view, the contact is thus formed of two contact elements, one mobile (namely the aforementioned elastic blade capable of being actuated by the push-button) secured to the case by its base and the other fixed, which is arranged on the electronic module (typically a contact pad arranged on the printed circuit board of the electronic module). In the aforementioned EP Patent No. 1 089 144, the second contact element is for example formed of a bent conductive lug of the printed circuit. It will thus be understood that the two contact elements are arranged on different frames, namely the case (to which the push-button is typically secured) for the first contact element, and the printed circuit board, for the second contact element.

One drawback of the aforementioned typical construction lies in the fact that the printed circuit board constitutes an element whose dimensions and position in the case cannot be guaranteed with a high level of precision. This lack of precision leads to a loss of precision as to the arrangement and travel of the push-button, which consequently has repercussions on the quality of actuation and use of the push-button. In order to improve precision, it is thus necessary to find another solution or at least to improve the existing solutions.

Another drawback of the aforementioned typical construction also lies in the liability of the contact to wear. In fact, the fixed contact element with which the mobile contact element is brought into contact, is generally made in the form of a metallisation made on the printed circuit board or a part secured to the printed circuit. Following repeated mechanical contacts between the contact elements, this metallisation can undergo significant wear and consequently reduce the quality of the electric contact. It is thus also sought to reduce the liability of the push-button control device to wear.

SUMMARY OF THE INVENTION

It is thus an object of the present invention to propose a solution that overcomes the aforementioned drawbacks of the prior art.

It is another object of the present invention to propose a solution that facilitates construction and assembling, in particular a solution adapted to automatic assembling of the components.

The present invention therefore proposes a push-button control device whose features are defined in the appended claims.

The main advantage of this control device lies in the fact that the two elements forming the contact, and the push-button itself, are arranged on the same support or frame (for example the case of the portable electronic instrument). Consequently, the arrangement of the constituent elements of the control device as well as the travel of the push-button can be adjusted very precisely. Unlike the solutions of the prior art, this precision is not a tributary of the precision and tolerances of the electronic module used. The electric contact of the push-button with this electronic module is nonetheless ensured by the fact that each contact strip forming part of the fixed contact element is in electric contact with the corresponding contact pad, namely a contact pad of the electronic module (such as a control input of the push-button) or a contact pad brought to a determined potential (for example a pole or a terminal connected to the pole of an electrical energy supply source). The electric contact is thus ensured by the movement of a mobile part of one strip on the other. This "strip on strip" contact also ensures better resistance to wear for the push-button control device.

The present invention also concerns a portable electronic instrument including a control device of the aforementioned type and whose features defined in the appended claims.

Particularly advantageous embodiments of the present invention form the subject of the dependent claims.

BRIEF DESCRIPTION OF THE DRAWING

Other features and advantages of the present invention will appear more clearly upon reading the following detailed description of a preferred embodiment of the invention, given solely by way of non-limiting example and illustrated by the annexed drawings, in which:

FIGS. 6*a* to 6*c* are respectively face, side and perspective views of a second contact strip of the push-button control device according to the preferred embodiment of the invention;

FIGS. 7*a* to 7*c* are respectively face, side and perspective views of a holding element for the contact strips of FIGS. 5*a* to 5*c* and 6*a* and 6*c* according to the preferred embodiment of the invention and also forming a spacer.

DETAILED DESCRIPTION OF A PREFERRED EMBODIMENT

Figure 1:
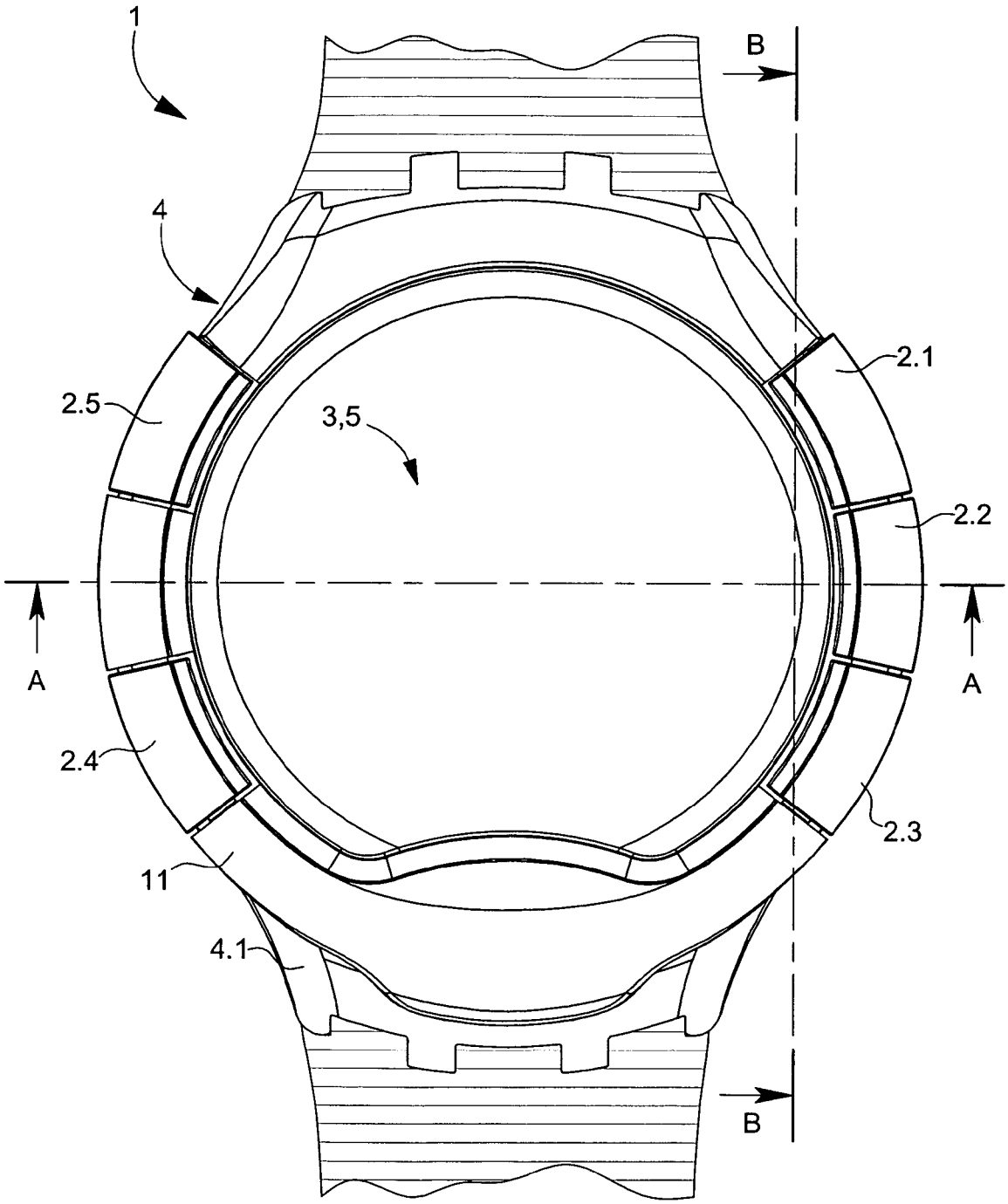
FIG. 1 is a plan view of a portable electronic instrument taking the form of a wristwatch incorporating a push-button control device in accordance with a preferred embodiment of the present invention, this portable instrument being particularly fitted with five push-buttons placed laterally on the case of the instrument.

FIG. 1 illustrates a general plan view of a portable electronic instrument taking the form of a wristwatch designated as a whole by the general reference numeral 1. This instrument 1 includes a case 4 enclosing in particular a display device 5, here a liquid crystal display, arranged underneath a glass 3, and an electronic module (not illustrated in this Figure), this case 4 taking here the form of a watch back cover-middle part onto which a bezel 11 is mounted. Five push-buttons respectively designated by the reference numerals 2.1, 2.2, 2.3, 2.4, and 2.5 are arranged laterally on case 4, respectively at 2 o'clock, 3 o'clock, 4 o'clock, 8 o'clock and 10 o'clock.

Figure 2:
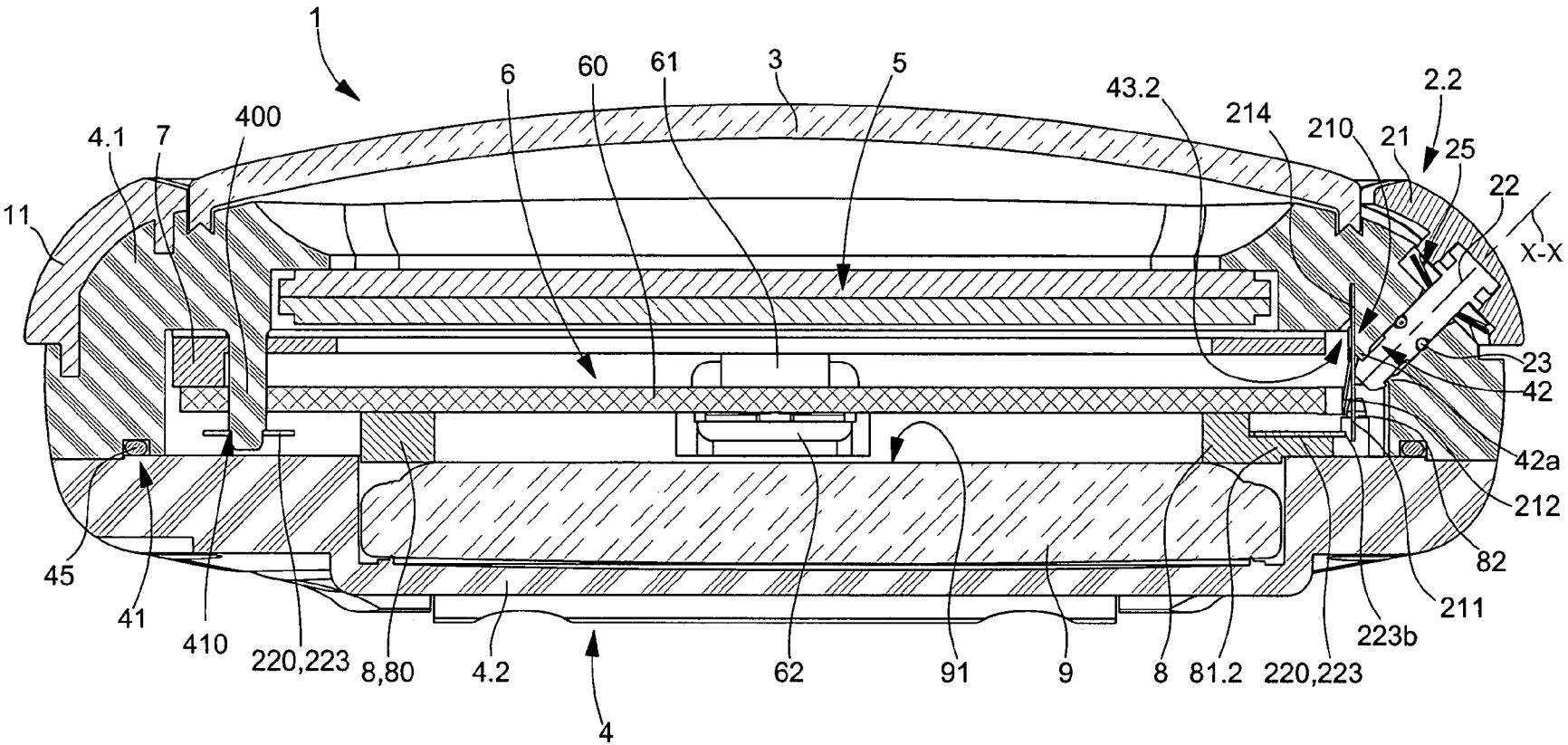
FIG. 2 is a cross-section of the instrument of FIG. 1 taken along the 9 o'clock-3 o'clock axis (line A-A indicated in FIG. 1)

FIG. 2 shows a cross-section of the instrument of FIG. 1 taken along a line of cross-section along the 9 o'clock-3 o'clock axis (line of cross-section A-A indicated in FIG. 1). In this cross-section, certain elements located outside the cross-sectional plane are illustrated. FIG. 2 shows again case 4 formed, as illustrated, of two parts 4.1 and 4.2, respectively forming a middle part and a back cover, secured to each other by securing means that are not illustrated (for example by means of screws), a sealing gasket 45 being particularly arranged between these two parts in a groove 41 arranged in middle part 4.1. By way of non-limiting example, case 4 is made of a synthetic material such as plastic, the glass 3 then being welded in a suitable manner, for example by ultrasound, onto middle part 4.1. Bezel 11 is fitted onto dial 4.1, here by two material injectin moulding.

As illustrated in FIG. 2, the liquid crystal display device 5 and the electronic module, designated by the reference numeral 6, are arranged in the housing arranged inside middle part 4.1. A housing is also arranged in back cover 4.2 for receiving an electrical energy power source 9, taking the form here of a button type battery.

Electronic module 6 includes as illustrated a printed circuit board 60 (hereinafter simply called "printed circuit") carrying, on each of its faces (or at least one) a set of electric and/or electronic components designated overall by the reference numerals 61, 62. Given that fact that, in the example illustrated, components are arranged on both faces of printed circuit 60, spacers 7, 8 are arranged on either side of printed circuit 60 to ensure spacing and suitable support in relation to the neighbouring elements. A first spacer 7 is thus arranged on the glass side to ensure support for module 6 in middle part 4.1 and on display device 5. A second spacer 8 is arranged on the back cover side to ensure support for module 6 in relation to back cover 4.1 and battery 9. It will already be noted here that the second spacer 8 also participates in holding the push-button control device according to the invention. We will return to its additional role hereinafter.

Figure 4:
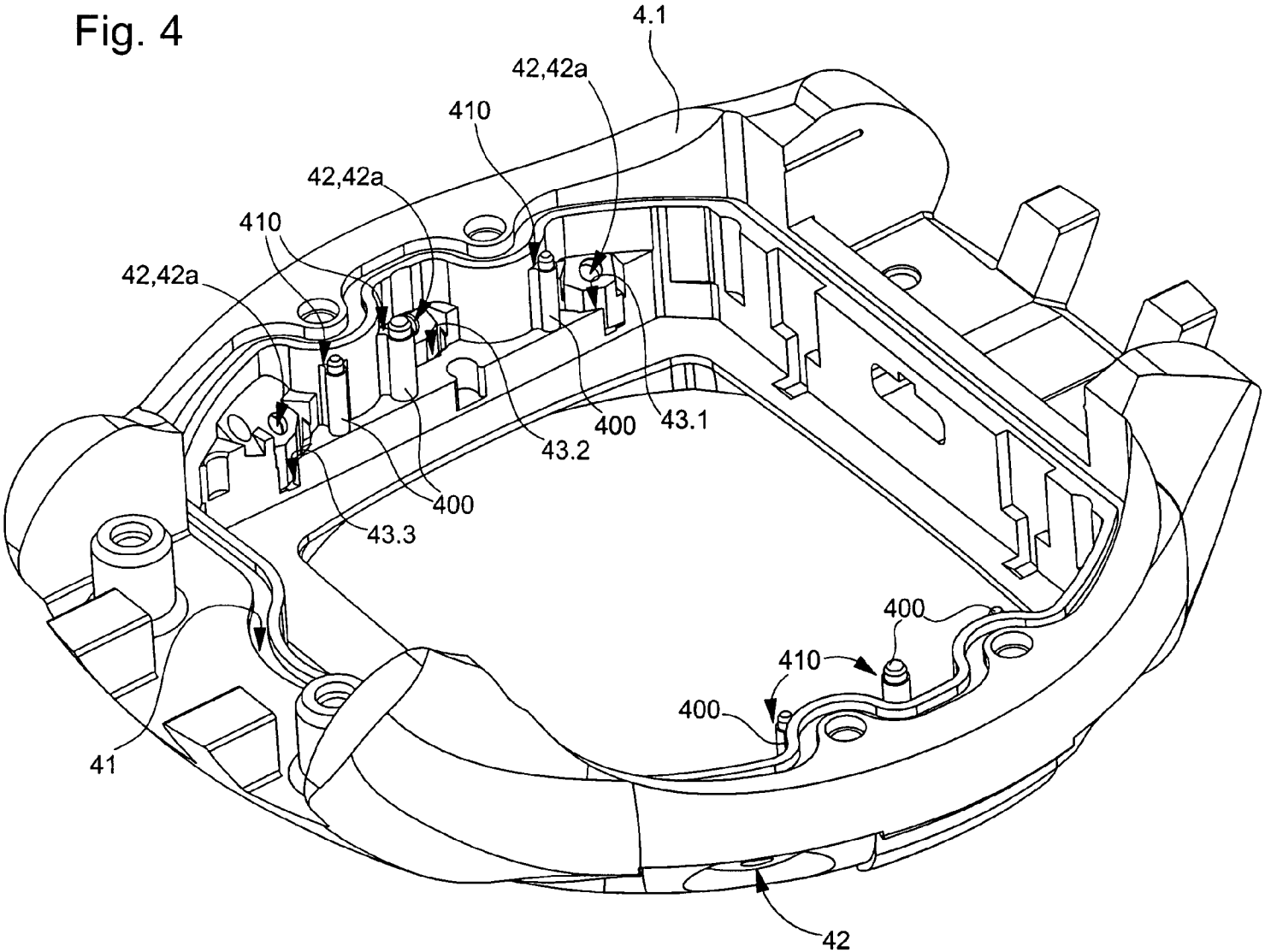
FIG. 4 is an isometric view of a part of the case of the instrument of FIG. 1 (top part of the case) forming the support of the push-button control device according to the invention.

In FIG. 2 it can be seen that middle part 4.1 includes a stud (in this case several studs as illustrated particularly in the isometric view of FIG. 4) designated by the reference numeral 400 which here passes through an orifice arranged through electronic module 6. This stud 400 (as well as the others) includes a shoulder 410 on its end part, the usefulness of which we will return to hereinafter.

We will concentrate more particularly now upon the subject of the present Application, namely the push-button control device. FIG. 2 shows a part of this control device in conjunction with push-button 2.2 located at 3 o'clock. As illustrated, this push-button 2.2 includes a head 21 secured to a stem 22 inserted in an orifice 42 arranged in middle part 4.1. It will be noted that push-button 2.2 (like the other push-buttons) is retained in the case by the end of stem 22. This latter has one wider end cooperating with a bulge of material 42*a* arranged at the exit of orifice 42. Upon mounting the push-button is inserted into its orifice 42, the bulge of material slightly deforming at the passage of stem 22 to return to place and hold the push-button by the end of its stem. An O ring joint 23 arranged in a groove of stem 22 ensures water resistance as regards the push-button. It will also be noted that the push-button incorporates a snap type control device 25, arranged between the base of the head 21 of the push-button and middle part 4.1, this snap type control device being of the type disclosed in EP Patent No. 1 162 251 also in the name of the present Applicant.

As partially illustrated in the cross-section of FIG. 2, the push-button control device includes a first metal contact strip designated as a whole by the reference numeral 210 and including a first elastic blade 211 placed on actuating axis X-X of the push-button so as to be actuated by the latter. As illustrated in FIG. 2, contact strip 210 is preferably fixed in the case by its base 214 (in this case in a groove arranged in middle part 4.1, this groove being designated here by the reference numeral 43.2) such that it is arranged in a substantially perpendicular plane to the plane of printed circuit 60 of electronic module 6. It will be understood that this contact strip 210 does not necessarily have to be arranged in this manner. It will be noted however that, as described hereinafter, contact strip 210 is particularly arranged in this manner to cooperate with an edge of printed circuit 60 as well as with an edge of the second contact strip of the control device.

Figure 8A:
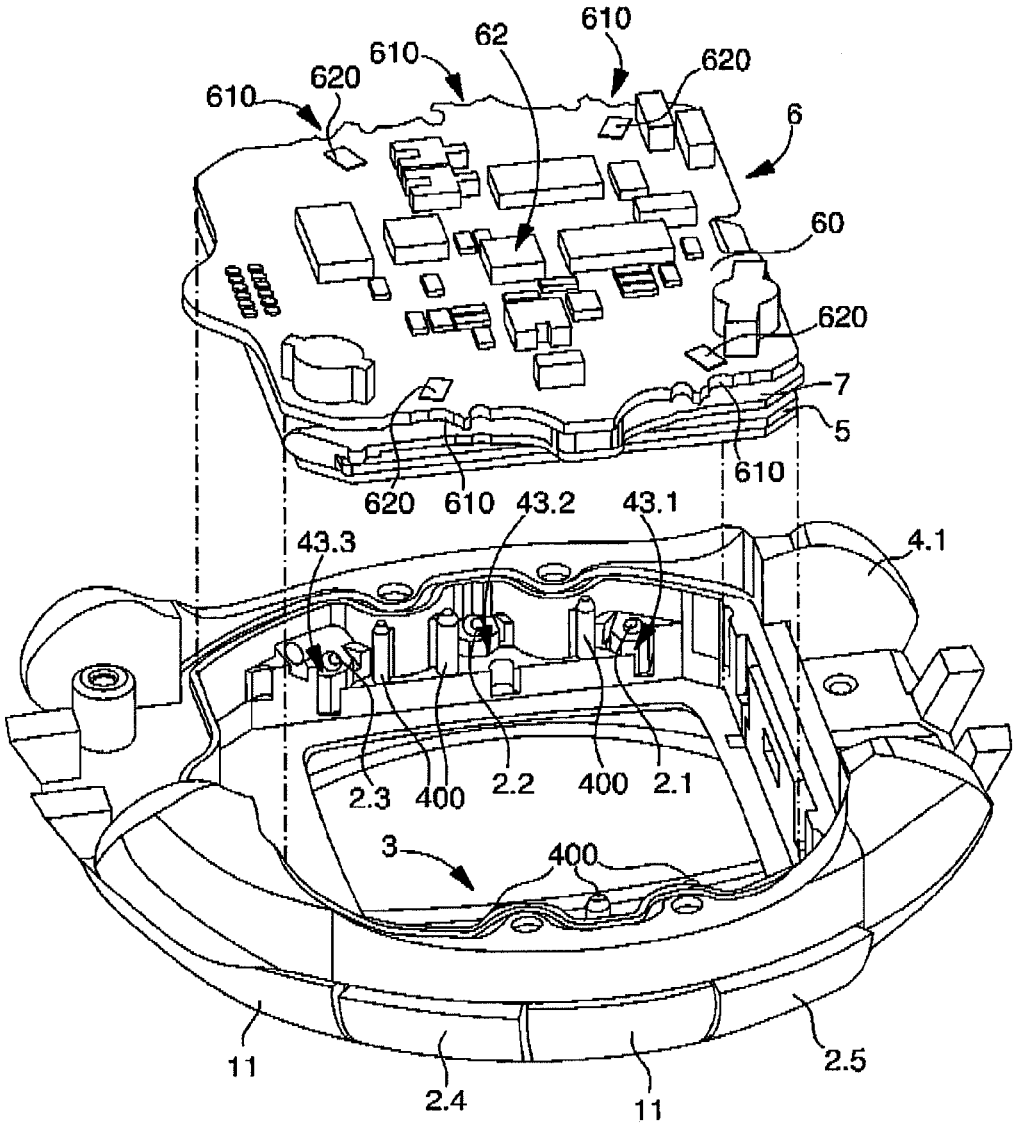
FIGS. 8*a* to 8*c* are perspective views illustrating three intermediate assembly phases in the case of the elements illustrated in the Figures hereinbefore, namely respectively the mounting of the electronic module, first push-button contact strips and second contact strips.
Figure 8B:
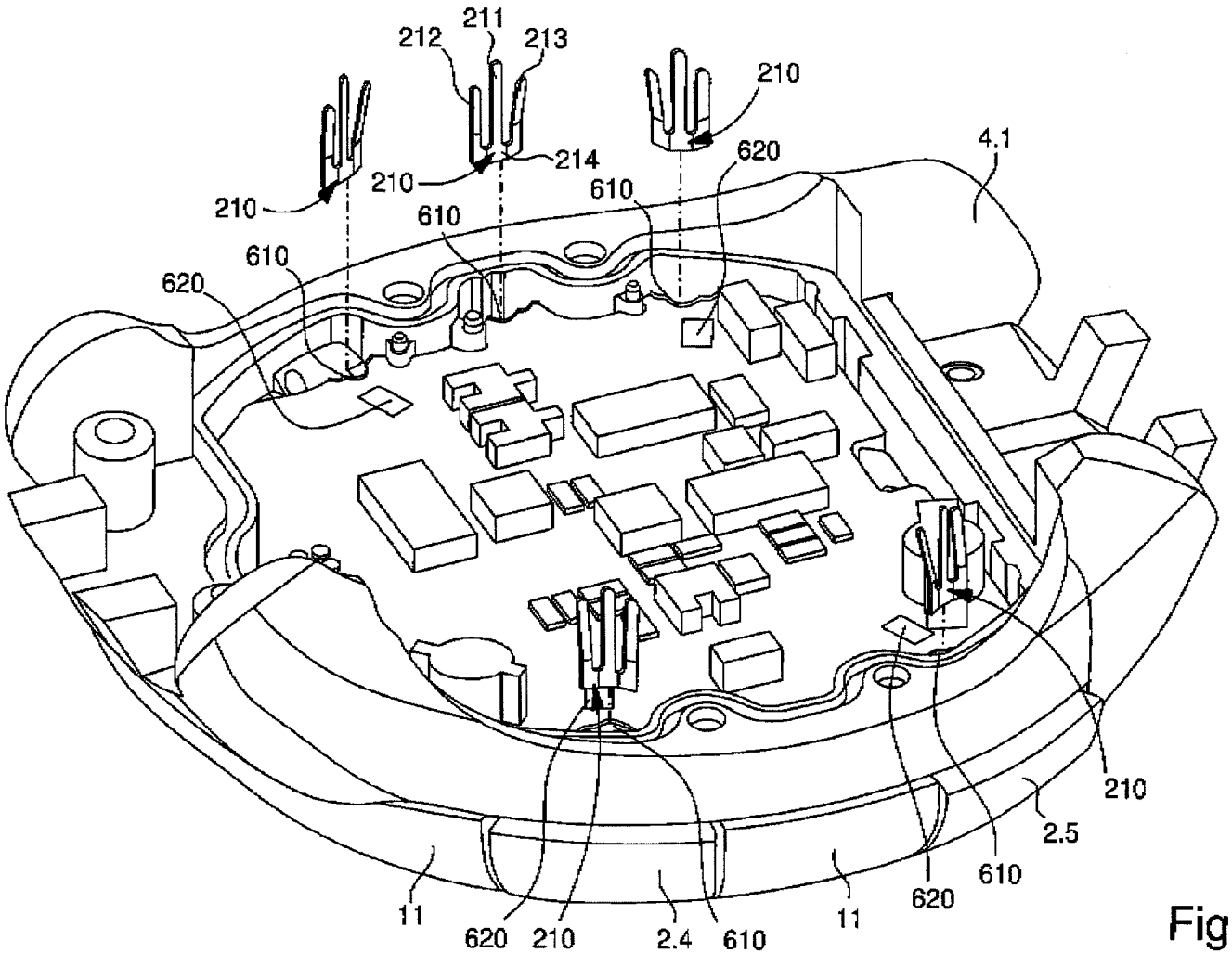
Figure 8C:
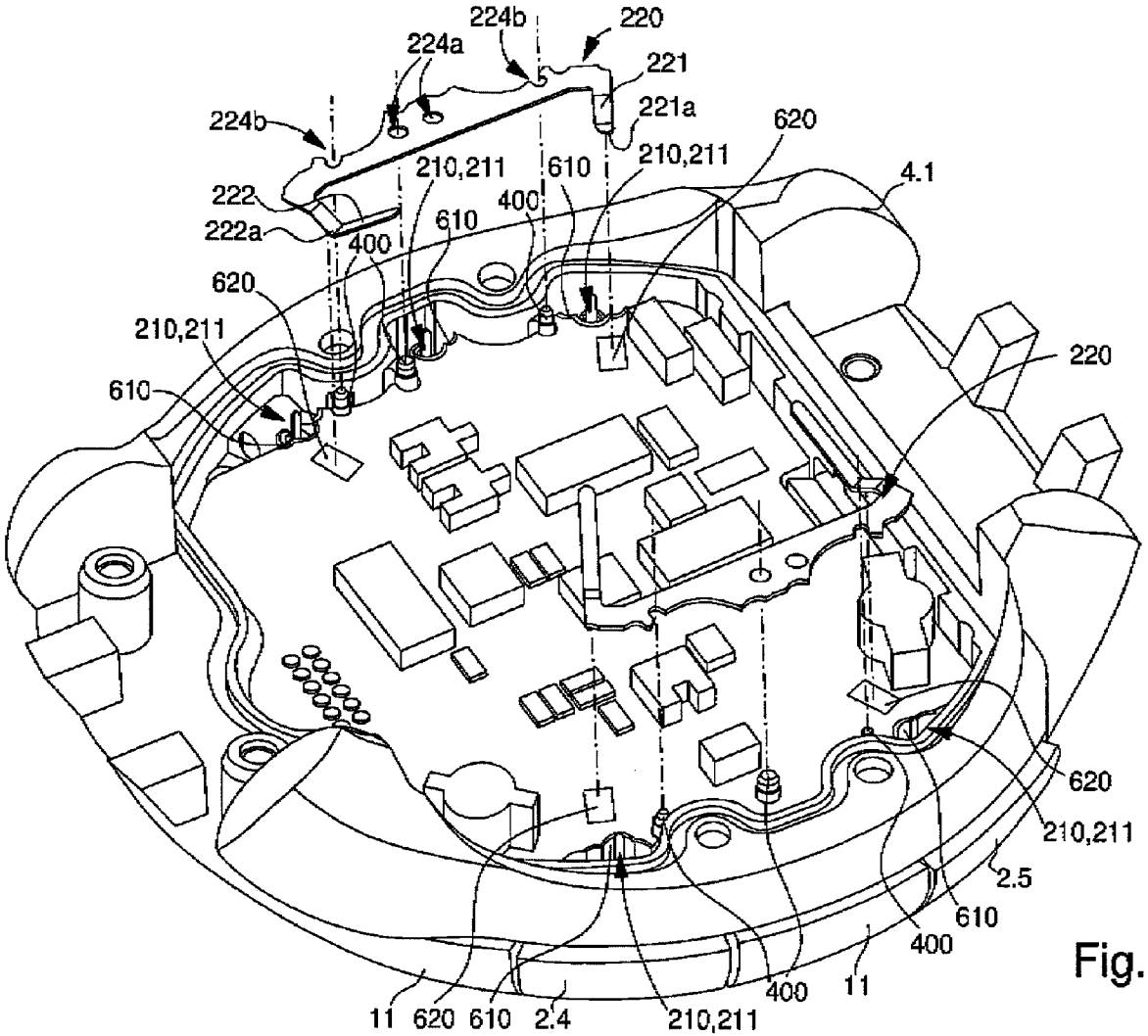

In the background of FIG. 2, it can also be seen that the first contact strip 210 includes at least one second elastic blade, designated here by the reference numeral 212, slightly bent outside the plane of the strip to come into contact with one edge of printed circuit 60 of the electronic module, or more exactly with a corresponding contact pad, designated hereinafter by the reference numeral 610, arranged on the edge of printed circuit 60. FIGS. 8*a* to 8*c* show more clearly the five contact pads 610 associated with push-buttons 2.1 to 2.5 arranged on the edge of printed circuit 60. These contact pads 610 are typically made in the form of an appropriate metallisation (for example copper or gold) of localised zones of the edge of printed circuit 60. In the preferred embodiment illustrated in the Figures, it will be noted that the first contact strip includes, in reality, in addition to elastic blade 211 placed on the axis of actuation X-X of the push-button, two other elastic blades 212, 213 in electric contact, preferably permanently, with the edge of printed circuit 60, these elastic blades 212, 213 being placed symmetrically on either side of the elastic blade 211, this arrangement ensuring better support and better stress distribution in the strip when the push-button is actuated.

Figure 5B:
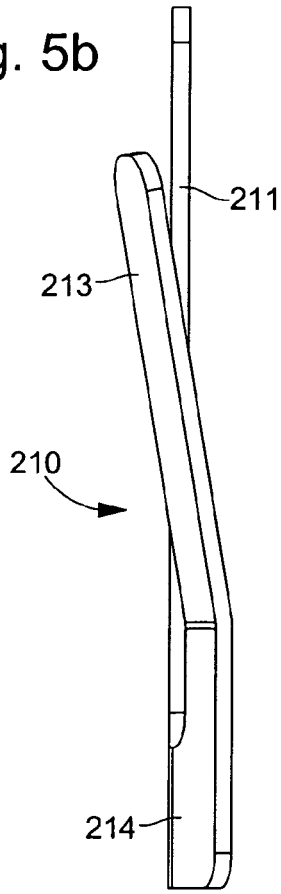
FIGS. 5*a* to 5*c* are respectively face, side and perspective views of a first contact strip of the push-button control device according to the preferred embodiment of the invention.
Figure 5A:
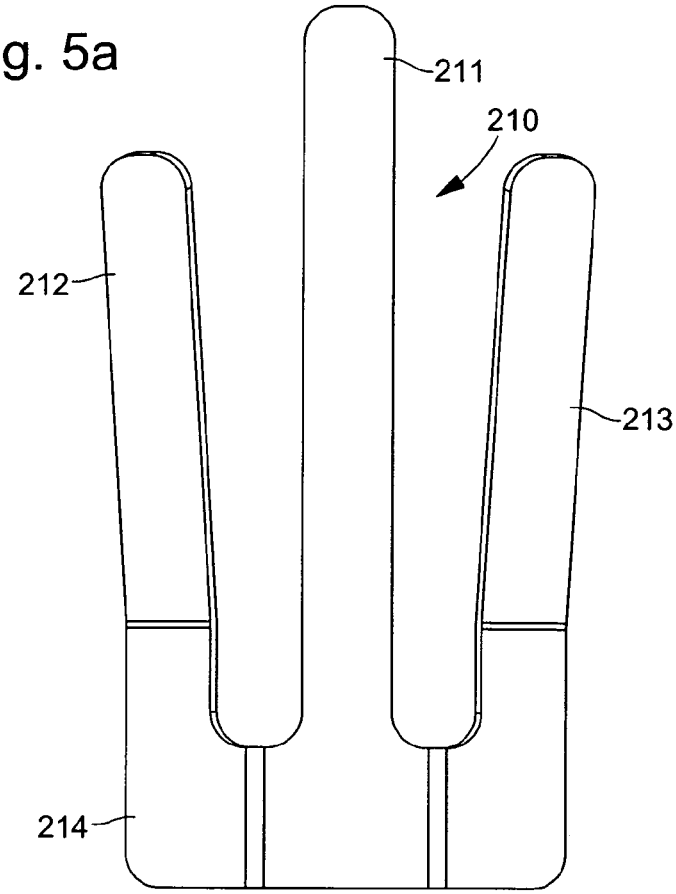
Figure 5C:
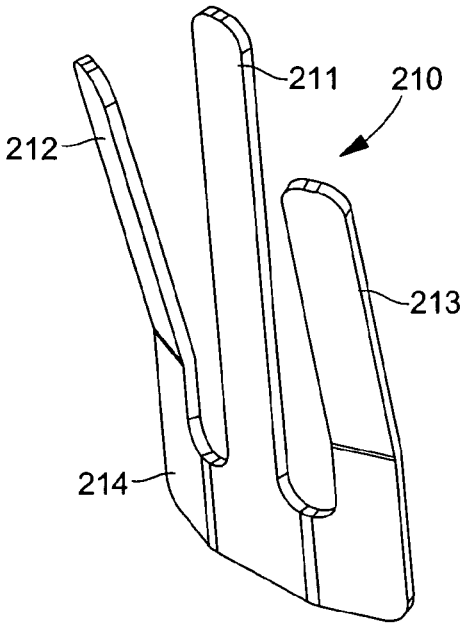

A detailed illustration of the first contact strip 210 is presented in FIGS. 5*a* to 5*c*. It can be seen that contact strip 210 preferably has a general "E" shape comprising a base 214 via which the strip is fitted into the case, elastic blade 211 in the central position, secured to base 214 and intended to be actuated by the push-button, and two peripheral blades 212, 213 also secured to base 214, these latter being slightly bent by ten or so degrees outside the plane of the strip as illustrated in FIGS. 5*b* and 5*c*. Base 214 of contact strip 210 also has a curved profile so as to ensure proper positioning of the strip in its mounting groove. This base 214 could also be provided with a notch collaborating with a corresponding protuberance of the mounting groove in order to further improve its resistance to any lateral movement in the mounting groove. It will be noted that the control device of each push-button includes a first contact strip of the type illustrated in FIGS. 5*a* to 5*c*, an equivalent number of mounting grooves being also made in the corresponding lateral parts of middle part 4.1 as illustrated in the isometric view of FIG. 4 (only the mounting grooves 43.1, 43.2 and 43.3 of push-buttons 2.1 to 2.3 being visible in this Figure).

Figure 3:
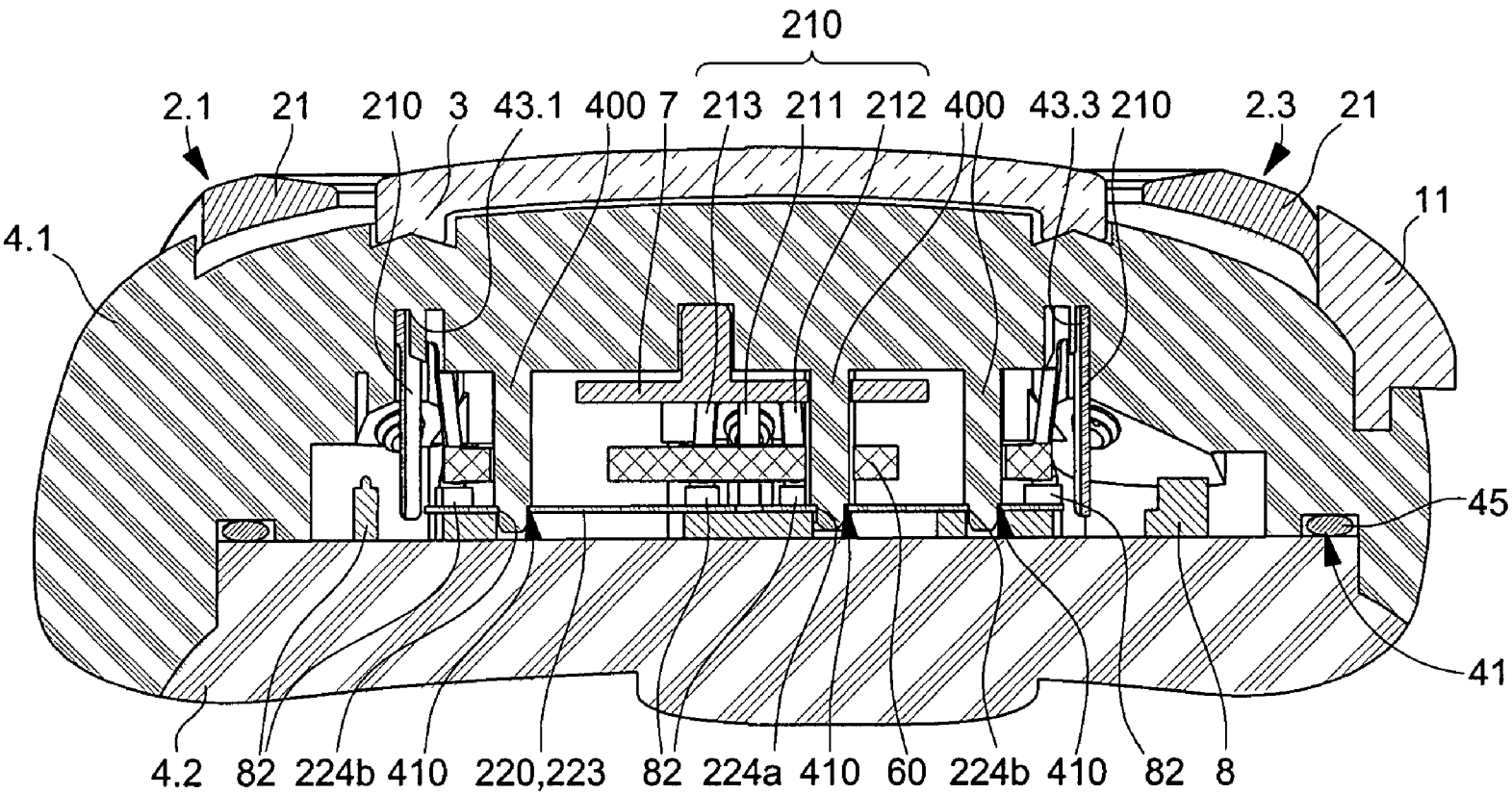
FIG. 3 is a cross-section of the instrument of FIG. 1 taken along an axis parallel to the 6 o'clock-12 o'clock axis (line B-B indicated in FIG. 1 also added to FIG. 6*a*)

The push-button control device according to the invention also includes a second metal contact strip designated as a whole by the reference numeral 220. This second contact strip 220 is preferably arranged here in a substantially parallel plane to the plane of printed circuit 60 as can be seen for example in FIGS. 2 and 3. In this case, the second contact strip 220 is arranged such that elastic blade 211 of the first contact strip 210 can come into contact with one edge of second contact strip 220 (c.f. in particular FIG. 2). As will be seen hereinafter, the second contact strip 220 is in electric contact, preferably permanently, with a contact pad, designated by the reference numeral 620 (c.f. particularly FIGS. 8*a* to 8*c*) arranged on the opposite reverse side of printed circuit 60. Preferably, this second contact strip 220 is also in electric contact, advantageously permanently, with a pole 91 (here the positive pole) of battery 9. Consequently, second contact strip 220 forms, with its associated contact pad 620, a contact element whose electric potential is fixed by the potential of pole 91 of electric energy source 9 with which the strip is in contact. The second contact strip 220 consequently forms both a contact element for the push-buttons and an electrical connecting element for bringing a first electric potential onto electronic module 6.

FIGS. 6*a* to 6*c* show a detailed illustration of the second contact strip 220. It will be noted that the push-button control device of the instrument illustrated in the Figures includes two contact strips of this type placed at 3 o'clock and at 9 o'clock for collaborating respectively with push-buttons 2.1 to 2.3, on the one hand, and 2.4 to 2.5 on the other hand. More particularly, the second contact strip 220 comprises a base 223 via which the strip is mounted on case 4, and first and second elastic blades or extensions 221, 222 secured to base 223. These extensions 221, 222 preferably extend outside the plane of base 223 and each have a "V" shaped profile comprising a bent part 221*a*, 222*a* and a free end part 221*b*, 222*b*. The bent parts 221*a*, 222*a* of extensions 221, 222 of the second contact strip 220 are intended to come into electrical contact with contact pads 620 arranged on the reverse side face of printed circuit 60 whereas the free end part 221*b*, 222*b* is intended to come into electrical contact with pole 91 of battery 9. FIGS. 8*a* to 8*c* show that in total four contact pads 620 are arranged on the reverse side face of printed circuit 60 to come into contact with bent parts 221*a*, 222*a* of two contact strips 220.

As illustrated in FIGS. 6*a* to 6*c*, the second contact strip 220 is provided with a set of assembly orifices and notches designated by the reference numerals 224*a* and 224*b* via which this strip is mounted in case 4. The assembly orifices and notches 224*a*, 224*b* are arranged to allow contact strip 220 to abut via its base 223 on shoulders 410 of studs 400 forming an integral part of middle part 4.1 of case 4. In fact, as illustrated in the isometric view of FIG. 4, the middle part is provided with six studs 400 each having a shoulder 400 on which the contact strip 220 abuts. In this case, each contact strip 220 is carried by three studs 400 as is shown for example in FIG. 3 which is a cross-section of the instrument in proximity to push-buttons 2.1, 2.2 and 2.3 taken along the line of cross-section B-B shown in FIG. 1 and in FIG. 6*a*.

It will be noted that two mounting orifices 224*a* are arranged in the base 223 of the second contact strip 220, only one of them being used however for carrying the strip in complement with notches 224*b*. It should be noted in fact that contact strip 220 placed at 9 o'clock is carried by the two notches 224*b* and mounting orifice 224*a* located at the centre, whereas contact strip 220 placed at 3 o'clock is carried by the two notches 224*b* and mounting orifice 224*a* located in an off-centre position, because of the presence of push-button 2.2 located at 3 o'clock as illustrated in FIG. 8*c*.

As already mentioned hereinbefore, the push-button control device is preferably designed such that the elastic blade 211 of the first contact strip 210 is capable of coming into contact with one edge of the second contact strip 220. Since second contact strip 220 is designed to cooperate with a number of push-buttons that can go up to three in the preferred embodiment shown by way of example in the Figures, it will thus be noted that the second contact strip 220 includes, on its edge, up to three contact regions 223*a*, 223*b* and 223*c* for receiving the central elastic blade 211 of each first contact strip 210. Thus, as illustrated in the cross-section of FIG. 2, the central elastic blade 211 of the first contact strip 210 associated with push-button 2.2 is capable of coming into contact with contact region 223*b* arranged on the edge of base 223 of the second contact strip 220. It will be noted that the contact region 223*b* arranged on contact strip 220 placed at 9 o'clock is not used.

From the foregoing, it will thus have been understood that the first and second contact strips 210 and 220 are all arranged on the same support or frame as the push-buttons, in this case on middle part 4.1 of case 4, each of the first contact strips 210 being fitted into a corresponding mounting groove arranged in middle part 4.1, whereas each of the second contact strips 220 is carried by the shoulders 410 of the studs integrated in middle part 4.1. Consequently, the arrangement of the constituent elements of the control device as well as the travel of the push-button can be adjusted very precisely, the precision of this adjustment no longer being dependent upon the precision and dimensional tolerances of the electronic module used. Moreover, the electrical contact of the push-button with the electronic module is ensured by the contact of the mobile part of the first strip on the edge of the second strip, thus ensuring better resistance to wear for the push-button control device.

As already mentioned hereinbefore, a (second) spacer 8 is arranged on the reverse side face of printed circuit 60 of electronic module 6. In addition to its conventional spacing and support function, this spacer 8, on the one hand, holds the two contact strips 220 in place and, on the other hand, holds the five contact strips 210 in place. The configuration of spacer 8 is illustrated in more detail in FIGS. 7*a* to 7*c*. As illustrated, this spacer 8 has an essentially annular shape with a support frame 80 provided with five arms 81.1 to 81.5. These arms 81.1 to 81.5 are arranged in positions corresponding to the location of the five push-buttons 2.1 to 2.5 and each being used to retain the first contact strips 210 in their respective housings via their two peripheral blades 212, 213 and to press the second contact strips 220 against the shoulders 410 of studs 400, this being visible in the cross-sections of FIGS. 2 and 3 (FIG. 2 showing for example how contact strips 210 and 220 are held in proximity to push-button 2.2 located at 3 o'clock). Moreover, each arm 81.1 to 81.5 is preferably fitted with a pair of studs 82. These studs 82 are directed to the glass side after spacer 8 has been mounted and are for providing the permanent contact of peripheral blades 212, 213 of each first contact strip 210 with the corresponding contact pad 610 arranged on the edge of printed circuit 60. In addition to arms 81.1 to 81.5, it will also be noted that frame 80 of spacer 8 is provided with four notches 83 for allowing the passage of extensions 221, 222 of the two contact strips 220 to come into contact with pole 91 of battery 9. Finally, the two studs designated by the reference numeral 85 position spacer 9 suitably in middle part 4.1.

Reference will now be made briefly to FIGS. 8*a* to 8*c*, which show three intermediate phases of the mounting of the push-button control device according to the preferred embodiment of the invention. As illustrated in FIG. 8*a*, after glass 3, push-buttons 2.1 to 2.5 and bezel 11 have been mounted on middle part 4.1, the assembly comprising electronic module 6, spacer 7 and display device 5 is housed in middle part 4.1. After this assembly has been mounted, the five contact strips 210 are inserted in their mounting groove, as illustrated in FIG. 8*b*, such that the two peripheral blades 212, 213 of each first contact strip 210 abut against the five corresponding contact strips 610 arranged on the edge of printed circuit 60. The two contact strips 220 placed on the reverse side are then arranged, as illustrated in FIG. 8*c*, on shoulders 410 of studs 400 of middle part 4.1, the bent parts 221*a* and 222*a* of extensions 221, 222 of each second contact strip 220 abutting against the four contact pads 620 arranged on the still exposed face of printed circuit 60. Following mounting of contact strips 220, spacer 8 illustrated in FIGS. 7*a* to 7*c* is then arranged to hold contact strips 210, 220 in place. Assembly of the instrument finally finishes, amongst other operations, by fixing the wristband, which is not shown, arranging sealing gasket 45 in its groove 41, and fixing back cover 4.2 comprising battery 9.

In the embodiment described hereinbefore, it was observed that the first contact strips 210 of the push-button control device are retained by means of the second spacer 8 and that the peripheral elastic blades 212, 213 of each of these contact strips 210 are in electric contact with a corresponding contact pad 610 arranged on the edge of printed circuit 60 of electronic module 6. It will be understood however that the contact strips 210 could alternatively be retained by printed circuit 60 itself. In order to do this, the ends of the peripheral elastic blades 212, 213 of contact strips 210 would only have to bent by approximately 90° in relation to the configuration illustrated in the Figures such that these ends can enter into contact with the glass side face of printed circuit 60 and contact pads 610 would have to be arranged not on the edge of printed circuit 60, but at the periphery of printed circuit 60 on its glass side face. In this alternative configuration, it will be understood that contact strips 210 should consequently be arranged in middle part 4.1 before the assembly formed of electronic module 6, display device 5 and spacer 7. It will also be understood that, in this configuration, the specific geometry of the second spacer 8 as illustrated in FIGS. 7*a* to 7*c*, with its arms 81.1 to 81.5 and its studs 82, is not longer necessary, since spacer 8 then only fulfilling its first role as spacing and support element.

Also by way of alternative, it would be perfectly possible to envisage bending the ends of the peripheral elastic blades 212, 213 of the first contact strips 210 as mentioned hereinbefore, but this time such that they can enter into contact with the reverse side face of printed circuit 60, contact pads 610 then being arranged on the periphery of printed circuit 60 on its reverse side face. In this second alternative configuration, the spacer again fulfils its additional role of retaining contact strips 210, however without the necessity of providing studs 82 envisaged in the embodiment illustrated in the Figures.

It will be noted that the two aforementioned alternatives have the particular advantage of not requiring the arrangement of metallisations on the edge of printed circuit 60 as is the case of the embodiment illustrated in the Figures, this advantage being able to reduce the manufacturing costs of electronic module 6.

It will be understood generally that various modifications and/or improvements evident to those skilled in the art can be made to the embodiment described in the present description without departing from the scope of the invention defined by the annexed claims. In the above description, it was for example observed that the peripheral blades of the first metal contact strip are preferably in permanent contact with the corresponding contact pads of the electronic module. Alternatively, these peripheral blades could only be brought into contact with corresponding contact pads when the push-button is actuated. This would, for example, advantageously enable the risk of electrostatic discharge via the push-buttons to be reduced.

The invention claimed is:

1. A push-button control device, including:

a support;

an electronic module arranged in or on said support;

a push-button mounted to be mobile on the support so as to have a travel in translation along an axis of actuation (X-X);

a first contact element including a mobile part placed on said axis of actuation (X-X) so as to be actuated by said push-button, and a second contact element with which said mobile part of the first contact element can be brought into contact in order to establish an electric connection between the first and second contact elements, wherein said first and second contact elements are respectively formed of a first metal contact strip and a second metal contact strip, both carried directly by said support, and at least one contact strip is in electric contact with a contact pad of the electronic module, and wherein said support comprises an annular frame secured to said electronic module and having a radially extending arm engaging and maintaining said at least one contact strip in said electric contact.

2. The control device according to claim 1, wherein said first contact strip is in electric contact with a first contact pad of the electronic module and wherein said second contact strip is in electric contact with a second contact pad of the electronic module.

3. The control device according to claim 2, wherein said second contact strip includes at least one extension having a "V" shaped profile including a bent part in electric contact with said second contact pad of the electronic module and a free end part in electric contact with a pole of an electric energy power source, such as a battery.

4. The control device according to claim 1, wherein the first contact strip is in electric contact with a first contact pad of the electronic module, wherein said second contact strip is in electric contact with a pole of an electric energy power source, such as a battery.

5. The control device according to claim 1, wherein said first and second contact strips are arranged in substantially perpendicular mid-planes, said first contact strip including a first elastic blade forming the mobile part of the first contact element, this first elastic blade being capable of coming into contact with one edge of said second contact strip.

6. The control device according to claim 1, wherein the first contact strip is in electric contact with a first contact pad arranged on the electronic module, wherein said first contact strip has a general "E" shape including:

a base via which said first contact strip is secured to said support;

a central blade connected via one of its ends to said base and forming the mobile part of the first contact element; and two peripheral blades arranged substantially symmetrically in relation to the central blade, each being connected via one of its ends to said base, the other end being in electric contact with said first contact pad.

7. A portable instrument including: a case and a push-button control device according to claim 1.

8. The electronic instrument according to claim 7, wherein said push-button is mounted in a lateral wall of said case and wherein said first and second contact strips are respectively arranged in substantially perpendicular and parallel mid-planes to the plane of said electronic module, said first contact strip including a first elastic blade forming the mobile part of the first contact element of the push-button control device, this first elastic blade being capable of coming into contact with one edge of said second contact strip.

9. The electronic instrument according to claim 8, wherein the first contact strip is in electric contact with a first contact pad arranged on the electronic module, wherein said first contact strip has a general "E" shape including:

a base fitted into said lateral wall of the case;

a central blade connected via one of its ends to said base and forming said first elastic blade; and two peripheral blades arranged essentially symmetrically in relation to the central blade, each being connected via one of its ends to said base, the other end being in electric contact with said first contact pad.

10. The electronic instrument according to claim 7, wherein the first contact strip is in electric contact with a first contact pad arranged on the electronic module, wherein said first contact pad is arranged at the periphery of said electronic module, on one side of the electronic module or on one of its faces.

11. The electronic instrument according to claim 1, wherein said frame also forms a spacer between said electronic module and an electrical energy power source, such as a battery.

12. The electronic instrument according to claim 7, wherein it includes a plurality of push-buttons (2.1 to 2.5) each associated with a first contact strip and wherein several of said push-buttons (2.1, 2.2, 2.3; 2.4, 2.5) sharing the same second contact strip.

* * * * *